US009079077B2

(12) United States Patent
Wolf

(10) Patent No.: US 9,079,077 B2
(45) Date of Patent: Jul. 14, 2015

(54) ADJUSTABLE PUTTER HEAD ASSEMBLY

(71) Applicant: Michael Wolf, Evansville, IN (US)

(72) Inventor: Michael Wolf, Evansville, IN (US)

( * ) Notice: Subject to any disclaimer, the term of this patent is extended or adjusted under 35 U.S.C. 154(b) by 18 days.

(21) Appl. No.: 14/088,927

(22) Filed: Nov. 25, 2013

(65) Prior Publication Data

US 2015/0148146 A1 May 28, 2015

(51) Int. Cl.

| | |
|---|---|
| ***A63B 53/02*** | (2006.01) |
| ***A63B 53/16*** | (2006.01) |
| ***A63B 53/04*** | (2015.01) |

(52) U.S. Cl.

CPC ..... *A63B 53/02* (2013.01); *A63B 53/0487* (2013.01); *A63B 2053/025* (2013.01); *A63B 2053/028* (2013.01)

(58) Field of Classification Search

CPC ..... A63B 53/02; A63B 53/0487; A63B 2053/028; A63B 2053/025

USPC ..... 473/313, 314, 244–248, 307

See application file for complete search history.

(56) References Cited

U.S. PATENT DOCUMENTS

| | | | | | |
|---|---|---|---|---|---|
| 2,155,830 | A * | 4/1939 | Howard | 473/246 |
| 3,392,977 | A * | 7/1968 | De Lacey | 473/306 |
| 3,397,888 | A * | 8/1968 | Springer et al. | 473/248 |
| 4,735,414 | A * | 4/1988 | Williams et al. | 473/248 |
| 4,736,951 | A * | 4/1988 | Grant | 473/246 |
| 5,116,047 | A * | 5/1992 | Phelan et al. | 473/307 |
| 5,253,869 | A * | 10/1993 | Dingle et al. | 473/245 |
| 5,390,919 | A * | 2/1995 | Stubbs et al. | 473/246 |
| 5,533,730 | A * | 7/1996 | Ruvang | 473/251 |
| 5,722,177 | A * | 3/1998 | Reilly, III | 33/508 |
| 5,924,938 | A * | 7/1999 | Hines | 473/307 |
| 6,019,686 | A * | 2/2000 | Gray | 473/313 |
| 6,988,956 | B2 * | 1/2006 | Cover et al. | 473/244 |

* cited by examiner

*Primary Examiner* — Sebastiano Passaniti
(74) *Attorney, Agent, or Firm* — Gary K. Price

(57) ABSTRACT

An adjustable putter head assembly having a hosel attachment member that includes a hosel for receipt of a golf club shaft, a striking face, a bottom surface, and an adjustment surface that is generally parallel to the striking face and opposite the striking face. The hosel attachment member further includes an extension member that includes an aperture for mating with a threaded opening of the adjustment surface, and a plurality of receptacles that vertically extend the length of the extension member and correspond with a plurality of settings disposed on the adjustment surface. The adjustment surface defines multiple hosel position points for selectively attaching the hosel along the length of the putter head, and, adjusting the angular orientation between the golf club shaft and bottom surface in the plane in which the shaft lies.

15 Claims, 5 Drawing Sheets

ADJUSTABLE PUTTER HEAD ASSEMBLY

CROSS REFERENCES TO RELATED APPLICATIONS

U.S. Provisional Application for Patent No. 61/875,255, filed Sep. 9, 2013, with title "Adjustable Putter Head Assembly" which is hereby incorporated by reference. Applicant claim priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

This invention relates generally to golf clubs, and more particularly to a golf club, such as a puller, having a head which is adjustable with respect to the elongated shaft that allows for modifications to the location of the hosel to the putter, and, modifications to the hosel angle thereby allowing for variations in the lie angle.

2. Brief Description of Prior Art

Golf is a popular sport played by many people throughout the world. As with most sports participants, golfers are constantly searching for ways to improve their performance on the course. For example, a golfer may change the way he grips the various clubs, the way he addresses the ball, his stance, his posture and his swing while trying to reduce his score by a few strokes. Putting is one part of the game where golfers typically make many adjustments to their playing style.

When a golfer makes changes to his playing style, the changes may necessitate the use of a club having characteristics different from the club that the player used prior to making the changes. For example, if a player adopts a more upright posture for putting, the change may require that his putter have a greater angle between the handle and the club head in order to position the end of the handle that the player grips higher off of the ground when the dub is in the playing position.

One way to accommodate changes to a golfer's playing style that require different dub configurations is for the golfer to obtain a different dub each time the change is made. This can be expensive and time consuming. An alternative is to use a dub that is adjustable. One obvious problem with adjustable dubs is that they do not typically provide the player with the desired "feel" as can be obtained with conventional clubs. For example, the components of the adjustable dub may become loose, which can be distracting to the player and interfere with the manner in which the dub impacts the ball. Another problem associated with adjustable dubs is that many do not conform to the United States Golf Association's rules of golf, and therefore cannot be used in situations which require compliance with such rules.

As will be seen from the subsequent description, the preferred embodiments of the present invention overcome disadvantages of the prior art adjustable clubs. In this regard, the present invention discloses a putter that allows for modifications to the location of the hosel to the putter, and then, modifications to the hosel angle thereby allowing for variations in the lie angle, and further provides a putter that conforms to the United States Golf Association's rules of golf.

SUMMARY OF THE INVENTION

An adjustable putter head assembly that allows for changing the location the hosel is attached to the putter head, and, allows adjustment of the hosel angle thereby allowing for variations in the lie angle. The putter head assembly includes a hosel attachment member having a hosel, a striking face, a bottom surface, and an adjustment surface that is generally parallel and opposite to the striking face.

The adjustment surface includes multiple position points for manual adjustment. The hosel attachment member defines an extension member that includes an aperture for selectively attaching to the adjustment surface, and a plurality of receptacles that vertically extend the length of the extension member, and correspond with settings disposed on the adjustment surface.

The selected positioning between the hosel attachment member and the adjustment surface allows for adjusting the location the hosel is attached to the putter, and, permits adjustment of the angular orientation between the golf club shaft and bottom surface in the plane in which the shaft lies.

BRIEF DESCRIPTION OF THE DRAWINGS

In the accompanying drawings, I have illustrated a present preferred embodiment of my invention in which.

DESCRIPTION OF THE PREFERRED EMBODIMENT

The present invention is directed to an adjustable putter head assembly that will allow for changing the point where the hosel is attached to the putter, and, allows for modification to the hosel angle thereby allowing for variations in the lie angle.

Figure 1:
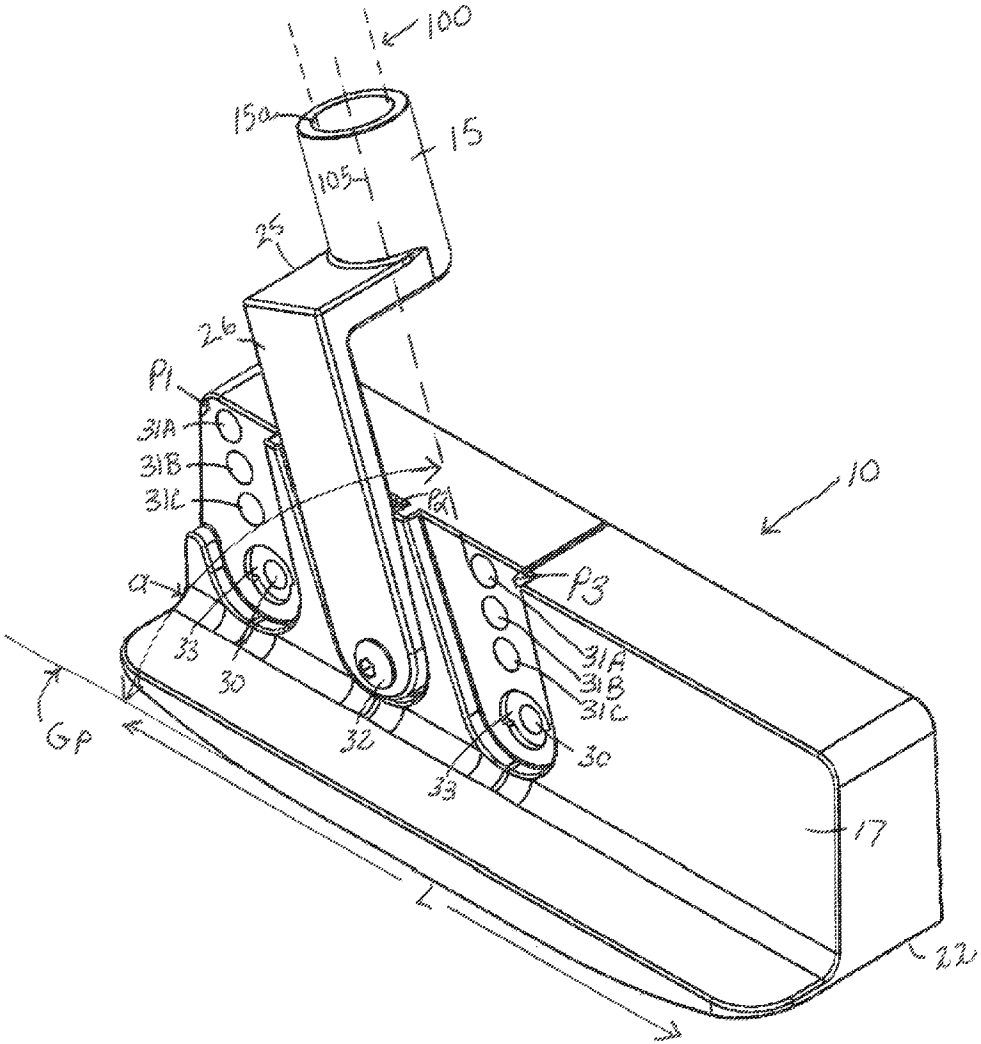
FIG. 1 is a perspective view of the preferred embodiment of the present invention, an adjustable putter head assembly, further illustrating the adjustment surface of the assembly.

FIG. 1 shows the assembly in the address position, shaft axis 105 intersects ground plane GP at an angle a, otherwise known as the lie angle. Because the lie angle is typically predetermined by the manufacturer and designated to fit an average size golfer, the lie angle for a taller golfer and the he angle for a shorter golfer can vary significantly. The present invention incorporates an adjustment means such that each individual golfer may benefit from the selected attachment of the hosel along the length of the putter head, and, an optimization of lie angle, and combination thereof. In the broadest context, the adjustable putter head assembly of the present invention consists of components configured and correlated with respect to each other so as to attain the desired objective.

FIGS. 1-5 illustrate the preferred embodiment of an adjustable putter head assembly, designated as numeral 10, made in accordance with the present invention. In application, the putter head assembly 10 includes a prior art elongated shaft 100 (shown with broken lines in FIG. 1) that, as known in the art, is received in a hosel 15 that defines a cavity 15*a* sized and shaped for receiving the elongated shaft 100.

The hosel 15 is disposed adjacent an adjustment surface 17 of the assembly 10. As illustrated, the assembly 10 further includes a generally parallel striking face 20 and a bottom surface 22. The striking face 20 of the assembly 10 having a traditional shape and appearance. Bottom surface 22 normally rests on the ground GP when the golfer is addressing the ball. Adjustment surface 17 is preferably generally parallel to the striking face 20 and as illustrated, is located on the opposite side of the assembly from the striking face 20.

The hosel 15 is integral to the hosel attachment member 25. The hosel attachment member 25 includes an extension member 26 that defines a lower aperture 27 for, as will be described, attaching to the adjustment surface 17. The extension member 26 further defines an interior surface 28 (see FIG. 3) that includes a plurality of receptacles 25A, 25B, and 25C that are vertically disposed along the length of the interior surface 28 of the extension member 26. As illustrated, the plurality of receptacles 25A, 25B, and 25C are vertically disposed along the length of the interior surface 28 in parallel with a slanted orientation of each of the hosel positions P1, P2, and P3. As a result of this slanted orientation, the receptacles, as will be discussed, are in mating alignment with a plurality of threaded setting positions disposed in each hosel position of the adjustment surface 17.

The adjustment surface 17 defines multiple hosel positions designated as P1, P2, and P3. As illustrated, each of the hosel positions P1, P2, P3, are indents in the adjustment surface 17 that are sized and shaped for receiving the extension member 26. FIG. 1 shows an exemplary setting where the extension member 26 is selectively secured in hosel position indent P2.

It should be understood that specifications and requirements of each putter are as individual as the style and specifications of the golfers themselves. The assembly 10 allows for a traditional putter head style to be coupled with the hosel attachment member 25 for different shaft alignment characteristics to suit different tastes and needs of the individual golfer all with the same putter head assembly.

Location of Hosel to Putter Head

Securing the aperture 27 of the hosel extension member 26 to the selected hosel position threaded opening 30 (hosel position P1, P2, P3) changes the attachment point of the hosel 15 along the length L of the putter head assembly 10, allowing for selected characteristic differences based upon the location the hosel 15 is attached to the putter head assembly 10.

Lie Angle

Attachment means is further provided with each defined hosel position of the adjustment surface 17 and hose) attachment member 25 operative for selectively maintaining the angular orientation between the golf club shaft 100 and bottom surface 22. The attachment means preferably being each of the defined hosel positions P1, P2, and P3, including three (3) threaded settings 31A, 31B, and 31C, positioned, sized and shaped to align with the receptacles 25A, 25B, and 25C vertically disposed along the length of the interior surface 28 of the hosel extension member 26, such that there will be three (3) different lie settings that correspond with each of the multiple hosel positions P1, P2, P3.

Figure 5:
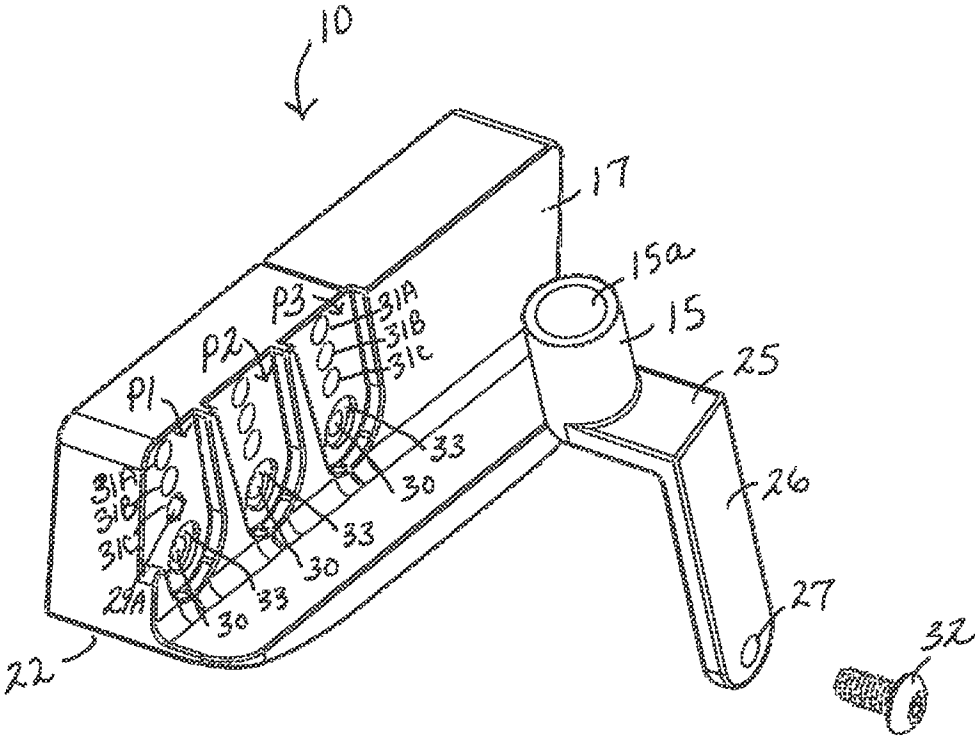
FIG. 5 is an exploded view of the assembly of FIG. 1, illustrating a set screw received in the assembly's second position setting of the first hosel position indent.

In application, preferably, a set screw 29 is threadably received in one of the selected threaded setting 31A, 31B, or 31C (lie angle) of the selected position indent P1, P2, or P3 (location of hosel to putter head). The set screw 29 is received such that a head portion 29A of the set screw 29 extends from the adjustment surface 17. FIG. 5 shows a exemplary setting where the head portion 29A is extending from the third position setting 31C of selected hosel position indent P1.

The adjustment member 25 is then first connected by the head portion 29A of the set screw 29 being received in the aligned receptacle.

Each defined hosel position P1, P2, and P3 further includes a lower threaded opening 30. The threaded opening 30 is then secured to the aperture 27 using fastening means known in the art, such as a threaded screw 32. It being understood that the threaded opening 30 of the adjustment surface 17 is to secure the adjustment member 25 with hosel 15 at a selected location along the length L of putter head 10, and, the selected settings 31A, 31B, or 31C, for adjusting the lie angle at that selected location.

One of the concerns with the "adjustable clubs" of the prior art, is that components may become loose during play which can be distracting to the player and interfere with the manner in which the club impacts the ball. To overcome this concern with the prior art, the hosel attachment member 25 is securely attached to the adjusting surface 17 using multiple attachment points. First, each lie angle setting 31A, 31B, and 31C is a threaded aperture for selectively receiving the threaded set screw 29 that when received in the selected setting 31A, 31B, or 31C, includes a head portion 29A that remains exposed, such that when the hosel attachment member 25 is received in the selected position indent P1, P2, or P3, as described, the head portion 29A aligns with and is received within one of the receptacles 25A, 25B, or 25C.

Second, once the hosel attachment member 25 is first connected to the adjusting surface 17 as described, the attachment member 25 is further secured to the adjustment surface 17 with the threaded screw 32 passing through the aperture 27 of the extension 26 and threadably received in the threaded opening 30 of the adjustment surface 17.

Figure 2:
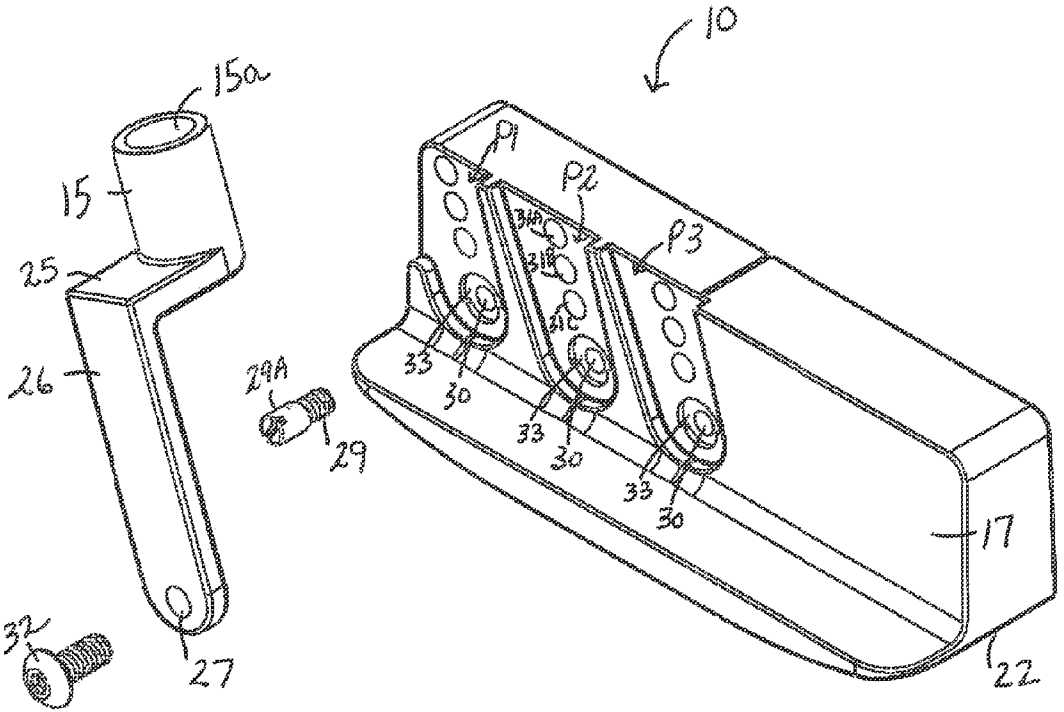
FIG. 2 is an exploded view of the assembly of FIG. 1, showing a first side view of the hosel attachment member.
Figure 3:
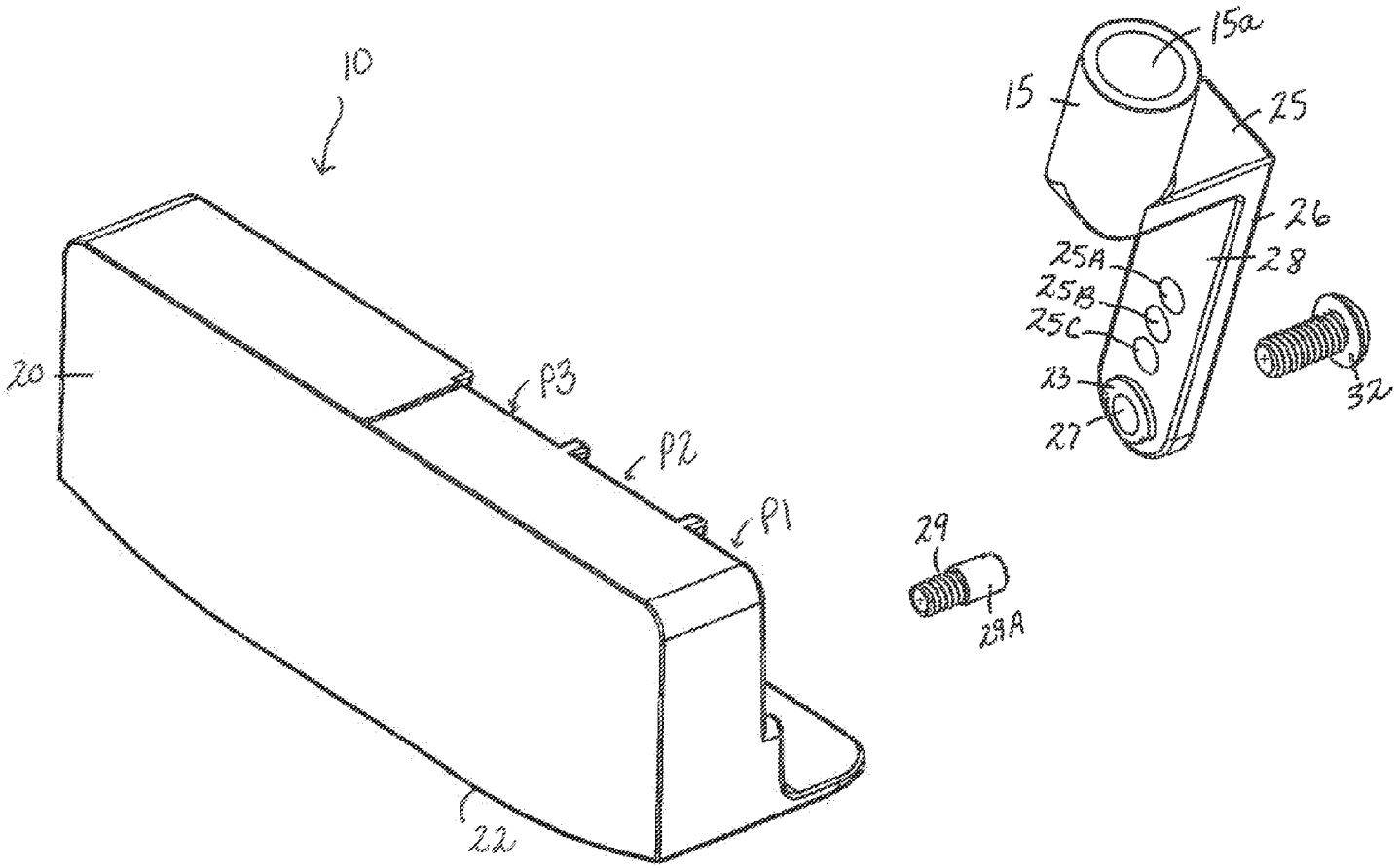
FIG. 3 is an exploded view of the assembly of FIG. 1, further illustrating the striking face of the assembly and a second or interior side of the hosel attachment member.
Figure 4:
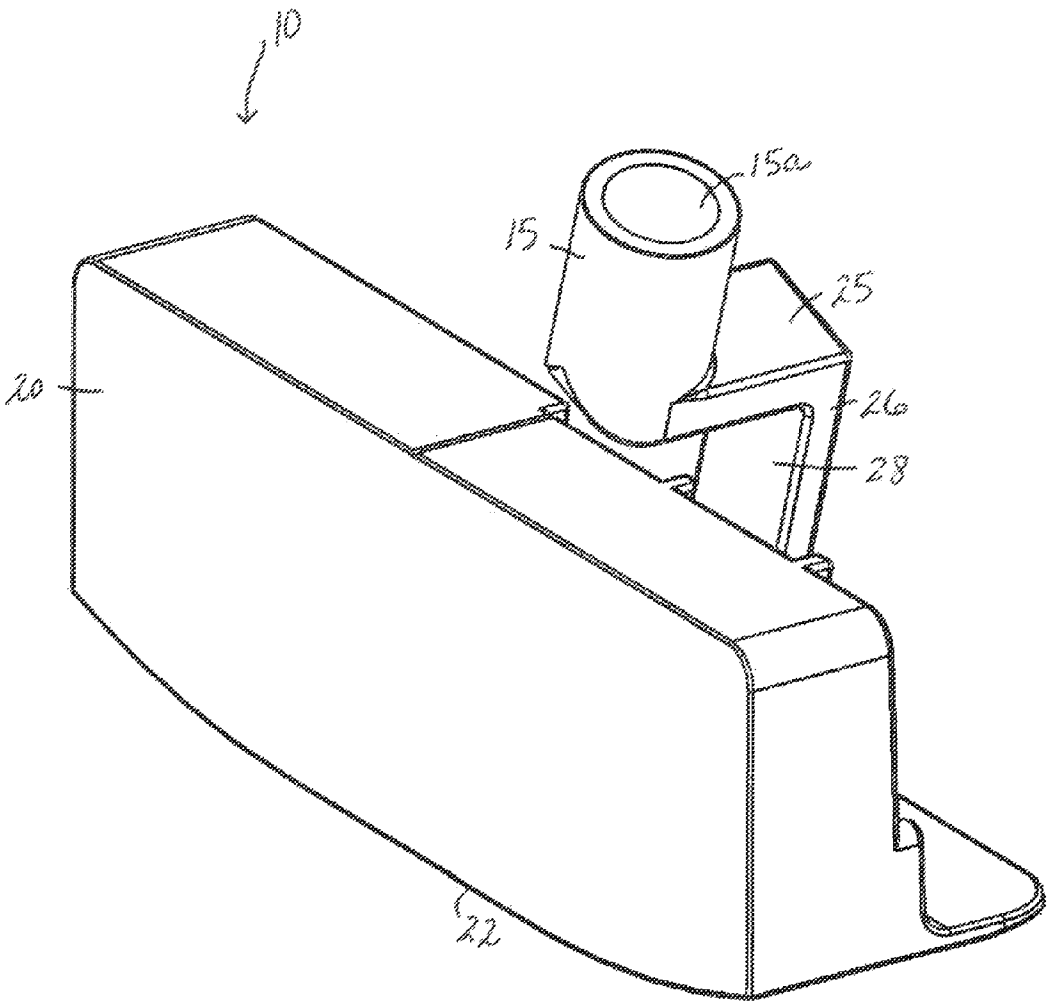
FIG. 4 is a perspective view of the assembly of FIG. 1, further illustrating the striking face of the assembly.

And, third, as best illustrated in FIGS. 1, 2 and 3, each of the threaded openings 30 further define a recess 33 (See FIGS. 1 and 2) that receives and mates with a lip 23 disposed on the hosel extension member 26 (See FIG. 3) to further maintain the hosel attachment member 25 to the selected position indent on the adjusting surface 17, and further prevent the hosel attachment member 25 from moving during the application.

The selected positioning between the hosel attachment 25 and the adjustment surface 17, as described, (1) permits selective attachment of the hosel 15 along the approximate length L of the putter head 10, and, (2) adjustment of the angular orientation between the golf club shaft 100 and bottom surface 22 in the plane in which the shaft lies.

The angular orientation between the golf club shaft 100 and bottom surface 22 may therefore be selectively varied between positive and negative inclinations from perpendicular with respect to bottom surface 22. However, the hosel positions P1, P2, and P3, are such that the minimum and maximum angular orientation between the golf dub handle and bottom surface 22 conforms with the current USDA rules of golf.

To change the location of the hosel 15 to the putter head assembly 10:

1) To adjust the angular orientation between the hosel 15 and the bottom surface 22, the set screw 29 is received in the selected setting 31A, 31B, 31C, of the selected hosel position P1, P2, P3. The head portion 29A of the set screw 29 is then received in the aligned receptacle 25A, 25B, or 25C of the hosel extension member 26;

2) The extension member 26 of the hosel attachment member 25 is received within the selected position indent (P1, P2, or P3); and, 3) The fastening means 32 is passed through the aperture 27 and threadably received in the threaded opening 30. Tightening the fastening means 32 further resists pivotal movement of the hosel attachment member 25 to the adjustment surface 17.

It will be appreciated that repeated adjustments to the location of the hosel and the angular orientation of the hosel to the adjustment surface 17 may be made in this manner.

Although the description above contains many specificities, these should not be construed as limiting the scope of the invention but is merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalence, rather than by the examples given.

I claim:

1. An adjustable putter head assembly comprising:

a hosel attachment member that defines an extension member and further includes an integral hosel, wherein said hosel defining a cavity sized and shaped for receiving a golf club shaft, a bottom surface, an adjustment surface that is generally parallel to a striking face of the putter head assembly and opposite the striking face, wherein said adjustment surface including multiple hosel positions, each of said multiple hosel positions configured to be releasably coupled with said extension member, means for selectively maintaining the location of said hosel along a length of said adjustment surface and for selectively maintaining an angular orientation between the hosel and said bottom surface, wherein said extension member includes a lower aperture, and wherein each of said multiple hosel positions includes a threaded opening that aligns with said lower aperture, each of said threaded openings configured to releasably connect to the lower aperture using a fastener, said extension member further includes a plurality of receptacles that vertically extend the approximate length of an interior of said extension member, and each of said multiple hosel positions includes a plurality of settings configured to releasably connect to each of said plurality of receptacles.

2. The adjustable putter head assembly as recited in claim 1, wherein each of said multiple hosel positions includes a recess configured to receive a lip defined on said interior of said extension member.

3. The adjustable putter head assembly as recited in claim 1, wherein said plurality of receptacles are vertically disposed at a slanted orientation and are in mating alignment with said plurality of settings in each of said multiple hosel positions.

4. The adjustable putter head assembly as recited in claim 3, wherein each of said multiple hosel positions is a defined indents in said adjustment surface, and wherein said indents are sized and shaped to be coupled with said extension member.

5. The adjustable putter head assembly as recited in claim 4, wherein each of said indents is disposed at said slanted orientation.

6. The adjustable putter head assembly as recited in claim 3, wherein each of said plurality of settings in each of said multiple hosel positions is disposed at said slanted orientation.

7. An adjustable putter head assembly comprising:

a hosel attachment member that defines an extension member and further includes an integral hosel, wherein said hosel defining a cavity sized and shaped for receiving a golf club shaft, a bottom surface, an adjustment surface that is generally parallel to a striking face of the putter head assembly and opposite the striking face, wherein said adjustment surface including multiple hosel positions, each hosel position configured to be releasably coupled with said extension member, means for selectively adjusting the location of said hosel along a length of said adjustment surface and for selectively adjusting an angular orientation between a defined shaft axis and said bottom surface, wherein said extension member includes a lower aperture, and each of said multiple hosel positions includes a threaded opening configured to be selectively coupled to said lower aperture using a fastener, wherein said extension member further include at least one receptacle that vertically extends the length of an interior of said extension member, and each of said multiple hosel positions includes at least one setting vertically disposed in each of said multiple hosel positions, said at least one setting configured to be selectively coupled to said at least one receptacle, and wherein each of said multiple hosel positions further includes a recess configured to receive a lip disposed on said interior of said extension member.

8. The adjustable putter head assembly as recited in claim 7, wherein said at least one receptacles is vertically disposed at a slanted orientation and is in mating alignment with said at least one settings in each of said multiple hosel positions.

9. The adjustable putter head assembly as recited in claim 8, wherein each of said multiple hosel positions is a defined indents in said adjustment surface, and wherein said indents are sized and shaped to be coupled with said extension member.

10. The adjustable putter head assembly as recited in claim 9, wherein each of said indents is disposed at said slanted orientation.

11. The adjustable putter head assembly as recited in claim 8, wherein each of said at least one settings in each of said multiple hosel positions is disposed at said slanted orientation.

12. An adjustable putter head assembly comprising:

a hosel attachment member that defines an extension member and further includes an integral hosel, wherein said hosel defining a cavity sized and shaped for receiving a golf club shaft, a bottom surface, an adjustment surface that is generally parallel to a striking surface of the putter head assembly, wherein said adjustment surface includes at least two indents configured to be releasably coupled with said extension member, wherein said extension member includes a lower aperture configured to be selectively coupled with a threaded opening disposed in each of said at least two indents, wherein said extension member further includes at least one receptacles that vertically extends the length of an interior of said extension member, said at least one receptacles configured to be selectively coupled with at least one settings vertically disposed in each of said at least two indents.

13. The adjustable putter head assembly as recited in claim 12, wherein each of said at least two indents further includes a recess that receives a lip disposed on said interior.

14. The adjustable putter head assembly as recited in claim 12, wherein said at least one receptacles is vertically disposed at a slanted orientation.

15. The adjustable putter head assembly as recited in claim 14, wherein each of said at least one settings in each of said indents is vertically disposed at said slanted orientation.

* * * * *